US007815383B2

(12) United States Patent
Hall

(10) Patent No.: US 7,815,383 B2
(45) Date of Patent: Oct. 19, 2010

(54) COMPACT PORTABLE TOOTHBRUSH

(76) Inventor: William Thomas Hall, P.O. Box 395, Kallua, HI (US) 96734

( * ) Notice: Subject to any disclaimer, the term of this patent is extended or adjusted under 35 U.S.C. 154(b) by 99 days.

(21) Appl. No.: 12/309,538

(22) PCT Filed: Feb. 15, 2007

(86) PCT No.: PCT/US2007/003906

§ 371 (c)(1),
(2), (4) Date: Jan. 22, 2009

(87) PCT Pub. No.: WO2008/033158

PCT Pub. Date: Mar. 20, 2008

(65) Prior Publication Data

US 2009/0288262 A1 Nov. 26, 2009

(51) Int. Cl.
*A46B 11/00* (2006.01)

(52) U.S. Cl. ..... 401/6; 401/48; 401/123; 401/268

(58) Field of Classification Search ..... 401/6–8, 401/268, 48, 131, 88, 123
See application file for complete search history.

(56) References Cited

U.S. PATENT DOCUMENTS

| | | | | |
|---|---|---|---|---|
| D97,360 | S | 10/1935 | Stevens | |
| D122,815 | S | 10/1940 | Crosby | |
| D136,631 | S | 11/1943 | Bernard et al. | |
| 2,438,641 | A | 3/1948 | Loehr | |
| D160,101 | S | 9/1950 | MacDonald | |
| 3,753,266 | A | 8/1973 | Ceniceros | |
| D230,219 | S | 1/1974 | Glaberson et al. | |
| 3,798,698 | A | 3/1974 | Conklin, Jr. | |
| 3,842,850 | A | 10/1974 | Sanders | |
| 3,842,851 | A | 10/1974 | Pipitone | |
| 4,454,623 | A | 6/1984 | O'Halloran | |
| 4,457,039 | A | 7/1984 | Massari | |
| 4,482,263 | A | 11/1984 | Palamara | |
| 4,502,177 | A | 3/1985 | Beggs | |
| D279,941 | S | 8/1985 | Anglim, Jr. | |
| 4,542,828 | A | 9/1985 | Gotto | |
| 4,620,528 | A * | 11/1986 | Arraval | 601/162 |
| 4,654,921 | A | 4/1987 | Dinner | |

(Continued)

FOREIGN PATENT DOCUMENTS

| | | |
|---|---|---|
| GB | 279018 | 2/1927 |

(Continued)

*Primary Examiner*—David J Walczak
(74) *Attorney, Agent, or Firm*—Richard C. Litman

(57) ABSTRACT

The compact toothbrush (10) has a handle that is designed so that the toothbrush (10) can be held within a user's open palm. The toothbrush's lower portion (12) has a substantially triangular contour. The toothbrush has a bristled head (14) and an oppositely disposed support rib (26). The support rib extends along the longitudinal axis of the toothbrush from an upper edge of the toothbrush's head (14), to a central region of the toothbrush's lower portion. The lower portion of the toothbrush handle has first and second opposed, outwardly flared side edges (30, 32) that are joined together at the lower edge (34) so that the lower portion has a substantially V-shaped cross-sectional contour. The user cups the toothbrush (10) in the palm of his hand and extends two fingers adjacent to the support rib to stabilize the toothbrush (10) while brushing his teeth.

12 Claims, 4 Drawing Sheets

U.S. PATENT DOCUMENTS

| | | | |
|---|---|---|---|
| 4,679,274 | A | 7/1987 | Friedman |
| 5,003,658 | A | 4/1991 | Rolleri |
| 5,014,383 | A | 5/1991 | Costar |
| 5,048,143 | A | 9/1991 | Carroll |
| D321,092 | S | 10/1991 | Woll et al. |
| 5,138,737 | A | 8/1992 | Thomas |
| D329,143 | S | 9/1992 | Booth et al. |
| D331,149 | S | 11/1992 | Piano |
| 5,511,273 | A | 4/1996 | Carroll |
| D389,312 | S | 1/1998 | Porter |
| 5,809,604 | A | 9/1998 | Olstyn |
| 5,826,599 | A | 10/1998 | Adams |
| 5,916,228 | A | 6/1999 | Ripich et al. |
| D422,414 | S | 4/2000 | Harada |
| 6,116,252 | A | 9/2000 | Stelmach |
| 6,134,737 | A | 10/2000 | Remme |
| 6,145,151 | A | 11/2000 | Herron et al. |
| 6,325,076 | B1 | 12/2001 | Ramirez |
| 6,481,443 | B1 | 11/2002 | Moore-Johnson et al. |
| D487,351 | S | 3/2004 | Frazell |
| 6,721,987 | B2 | 4/2004 | McDevitt et al. |
| D490,983 | S | 6/2004 | Tini |
| D492,117 | S | 6/2004 | Sarkar et al. |
| 6,793,434 | B1 | 9/2004 | Olson |
| 6,808,068 | B2 | 10/2004 | Abada |
| 6,821,043 | B2 | 11/2004 | Teh |
| D501,322 | S | 2/2005 | Fishman |
| 2003/0014826 | A1 | 1/2003 | Touzani |
| 2003/0041396 | A1 | 3/2003 | Dickie |
| 2003/0088930 | A1 | 5/2003 | Abada |
| 2004/0237995 | A1 | 12/2004 | Mualem |
| 2005/0251071 | A1 | 11/2005 | Zhadanov |

FOREIGN PATENT DOCUMENTS

| | | |
|---|---|---|
| GB | 2092437 | 8/1982 |
| JP | 2000-197522 | 7/2000 |

* cited by examiner

COMPACT PORTABLE TOOTHBRUSH

TECHNICAL FIELD

The present invention relates to dental appliances and accessories, and particularly to a compact toothbrush for cleaning teeth.

BACKGROUND ART

Typical toothbrushes include an elongated handle having opposed handle and head ends. Such toothbrush handles are typically relatively thin and linear in shape. The "long stemmed" handle end is designed for gripping by the user's clenched first. A plurality of toothbrush bristles located within the head portion augment the brushing of the user's teeth.

Although brushing one's teeth is generally not considered to be an embarrassing act, users tend to prefer concealing their hygienic practices from others. Typical toothbrushes with an elongated handle make such concealment difficult due to the fact that conventional linear toothbrushes are typically longer than an average user's hand. Further, such users typically utilize a clench-fingered grip, which readily exposes any intended concealment of the procedure. This commonplace practice also produces an obvious oscillating and/or gyrating hand operation during the brushing.

Further, conventional linear toothbrush handles are typically approximately six-inches long and are not well adapted for either concealed usage or compact portability. Due to the generally inflexible nature of the materials typically used in toothbrush manufacture, a conventional linear toothbrush cannot, therefore, be conveniently or comfortably stored in, for example, a user's pocket or purse. Quite often busy people on the go have neither the time nor the facilities to perform a complete teeth cleaning with a standard toothbrush and toothpaste in public places, but do want to have the opportunity to perform a cosmetic cleaning of at least the anterior teeth, e.g., the incisors and canines, in a discreet manner. It would therefore be desirable to provide a diminutive-sized toothbrush, which may be easily and securely held by the user while also attempting to conceal and carry out a discreet brushing process in public.

In addition, a need for a non-linear toothbrush arises among the afflicted or disabled, who may have difficulty in brushing with a clench-fingered grip due to such physical impairments as arthritis and limitations relating to artificial hands. Thus, a compact toothbrush solving the aforementioned problems of concealment, portability and mode of operation is desired.

DISCLOSURE OF INVENTION

The disclosure is directed to a compact toothbrush. The toothbrush handle is dimensioned and configured to be held within, and supported by, a user's open palm. The toothbrush head has a plurality of toothbrush bristles extending outwardly from the surface of the tooth brush. A support rib is formed on the toothbrush handle on the opposite side of the toothbrush from the bristles. The support rib extends along a longitudinal axis of the toothbrush handle from the upper edge of the toothbrush head to a central region of the lower portion of the toothbrush handle. When the lower portion of the toothbrush handle is cupped by a user's open palm, the user may extend at least two adjacent fingers so that the support rib is disposed between the two fingers to stabilize the compact toothbrush within the user's hand while the user brushes his teeth.

BRIEF DESCRIPTION OF DRAWINGS

Similar reference characters denote corresponding features consistently throughout the attached drawings.

BEST MODES FOR CARRYING OUT THE INVENTION

The compact toothbrush of the present invention include's a handle having an upper portion and a lower portion, with the lower portion being dimensioned and configured for being held within a user's palm. Preferably, the lower portion has a substantially triangular contour. The handle includes first and second opposed surfaces, and a plurality of toothbrush bristles are mounted to the upper portion of the handle and extend outwardly from the first surface.

A support rib is formed on the second surface of the handle and extends along a longitudinal axis of the handle from an upper edge of the upper portion to a central region of the lower portion. Preferably, the support rib is contoured to maximize comfort for the user. When the lower portion of the handle is received by the user's palm, the user may extend two or more adjacent fingers with the support rib disposed therebetween to stabilize the compact toothbrush within the user's open hand for brushing of the user's teeth.

Further, a cap may be provided for releasably covering the upper portion of the handle and the plurality of toothbrush bristles. Preferably, an annular interlocking seal is formed about the neck of the handle at the interface between the upper portion and the lower portion thereof, and the annular interlocking seal releasably and frictionally engages a lower edge of the cap for releasable mounting of the cap on the handle. The annular interlocking seal may be an annular rib, for example. Further, the cap preferably has an opening formed therethrough, allowing for the evaporative drying of the toothbrush bristles following use of the compact toothbrush.

At least one clamping member, receiving receptacle or the like may be provided on the lower portion of the handle for releasable attachment of a container to the handle. The container may be an aerosol-type breath spray canister, a non-aerosol mouth spray (e.g., an atomizer), or a container for a dentifrice.

Figure 1:
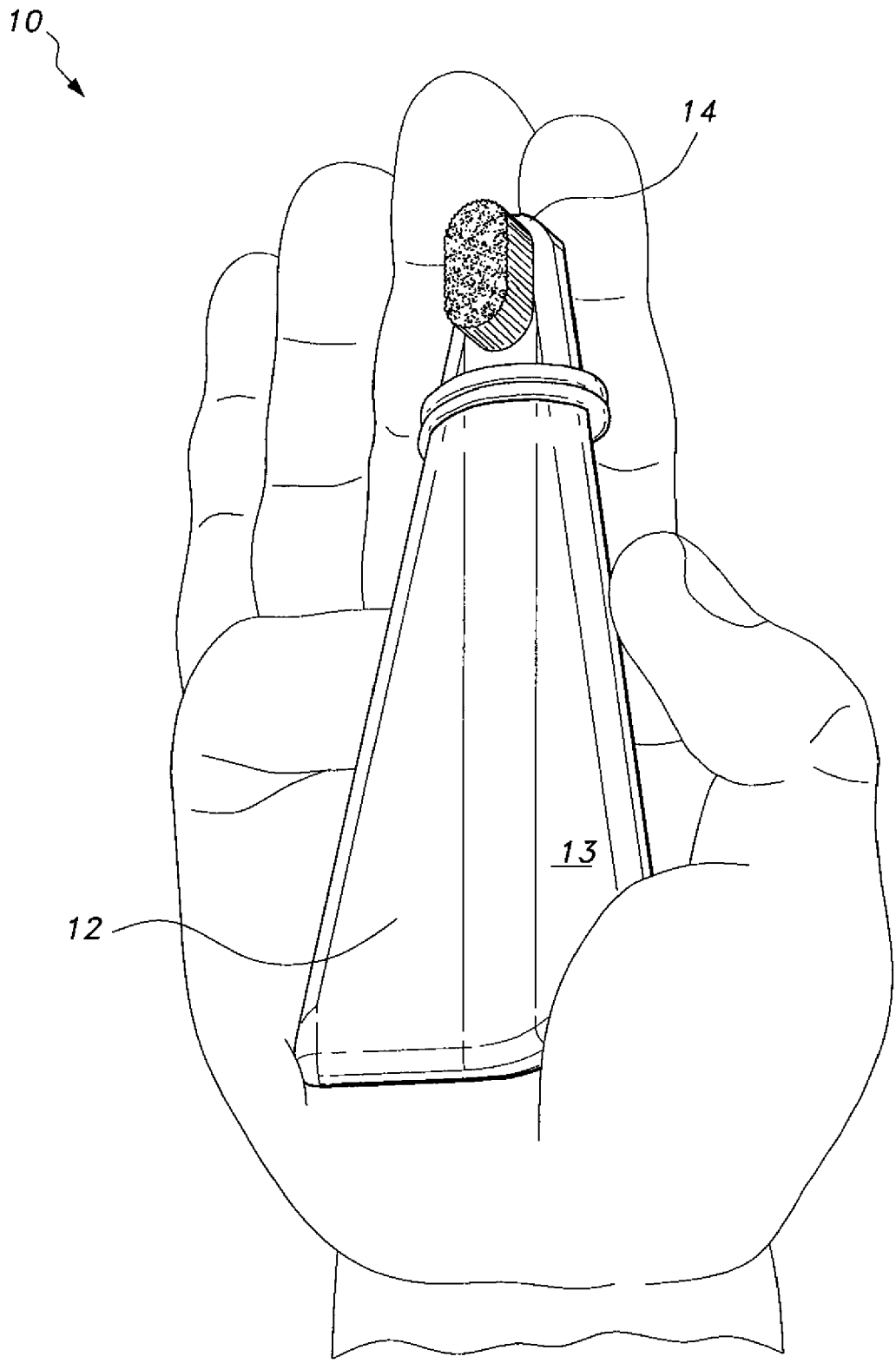
FIG. 1 is an environmental, perspective view of a compact toothbrush according to the present invention.
Figure 2:
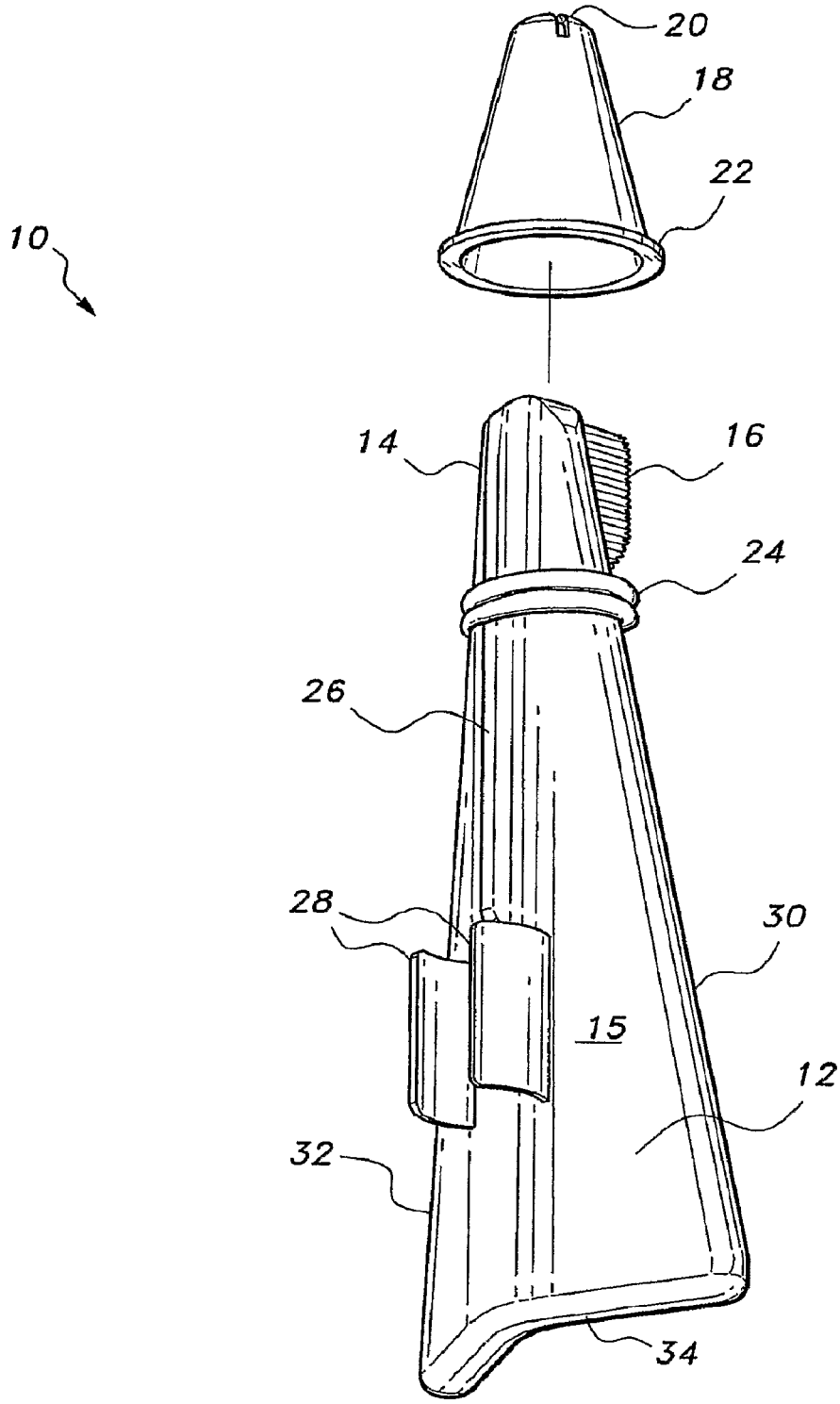
FIG. 2 is a rear perspective view of the compact toothbrush according to the present invention.
Figure 3:
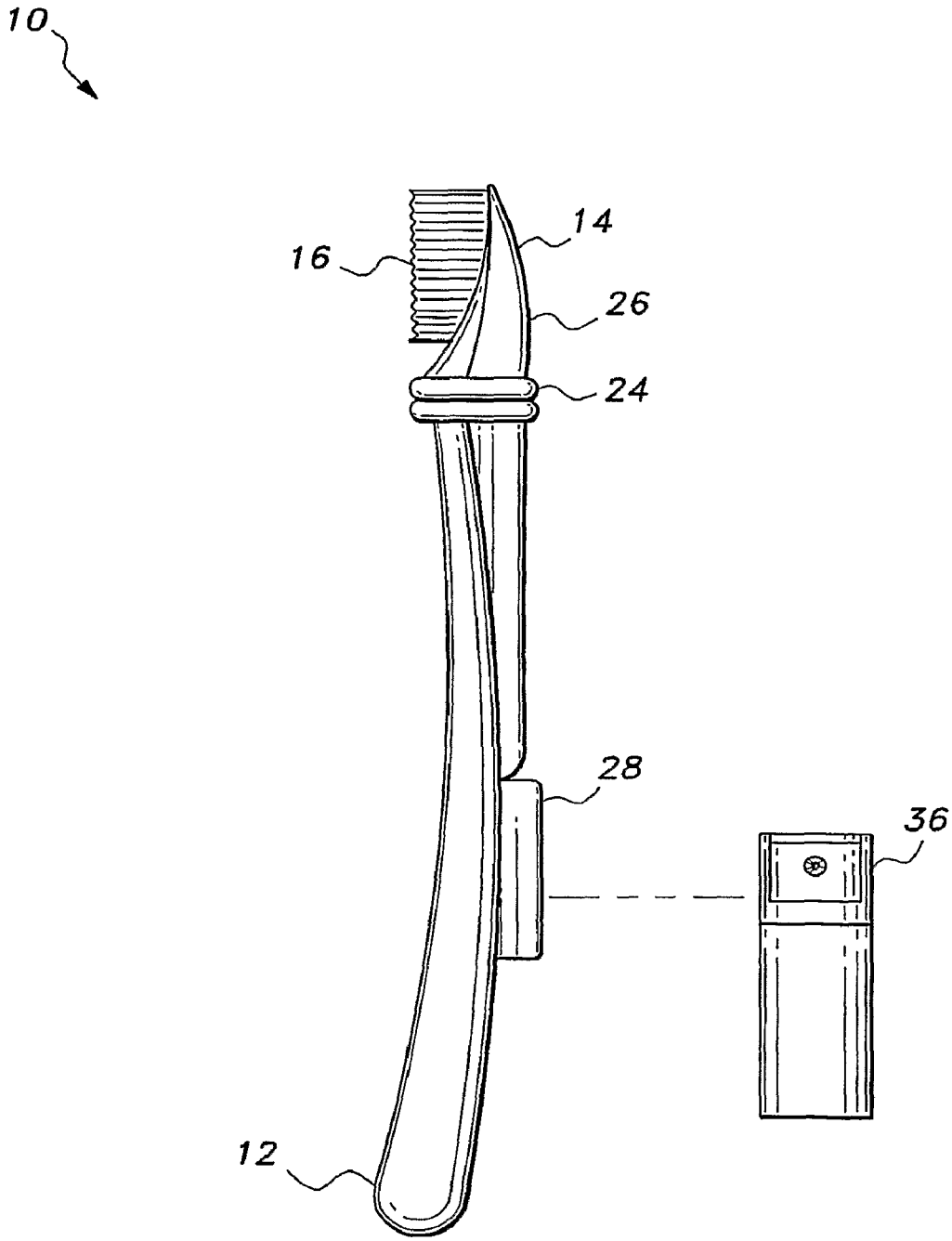
FIG. 3 is a side view of the compact toothbrush according to the present invention.

As illustrated in FIGS. 1-3, the compact toothbrush 10 includes a handle having an upper head portion 14 and a lower portion 12, with the lower portion 12 being dimensioned and configured for being held within a user's open palm (as best shown in FIG. 1). It should be understood that the terms "upper" and "lower" refer to the directionality represented by the orientation of compact toothbrush 10 represented in FIG. 1.

Preferably, the handle has a substantially triangular contour, as illustrated in the drawings, with the three corners being rounded or blunted to prevent injury or discomfort to the user during use. It should be understood that the rounded or blunted corners are shown in a preferred embodiment for illustrative purposes only, and, as described below, the handle may have any desired contour that allows the user to stably hold and anchor the handle within the user's open hand. The substantially triangular contour is defined by opposed side edges 30, 32, and a lower edge 34. Further, as shown in FIGS. 1 and 2, the lower portion 12 may have a substantially V-shaped or convex cross-sectional contour for reception within the user's palm. The compact toothbrush 10 is preferably sized to be received within, and concealed by, the user's open hand, as best illustrated in FIG. 1.

It should be understood that the handle of compact toothbrush 10 has a substantially triangular shape, such as that illustrated in the drawings, in a preferred embodiment only. The handle may have any suitable configuration. For example, the handle may have a substantially isosceles triangular shape, as shown, or may have a contour that is substantially similar to an equilateral or scalene triangle. Alternatively, for example, the handle may be trapezoidal, may resemble a triangle with concave side edges, may resemble a triangle with convex side edges, may be elliptical, may have a substantially triangulated T-shaped contour, may be pentagonal, may be formed as a semi-triangular ring, or may have any other suitable configuration which allows for open-handed stable mounting and retention of the handle. The handle of compact toothbrush 10 is preferably formed from plastic or from any other suitable rigid or semi-rigid material.

The handle includes first and second opposed surfaces, 13, 15, respectively, and a plurality of toothbrush bristles 16 are mounted to the upper head portion 14 of the handle and extend outwardly from the first surface 13. The plurality of toothbrush bristles 16 may be conventional toothbrush bristles, formed from plastic or any other suitable tooth cleaning materials. Any suitable number of bristles 16 may be mounted to the upper head portion 14, and may be arranged in any suitable manner.

A support rib 26 is formed on the second surface 15 of the handle and extends along a longitudinal axis of the handle from an upper edge of the head portion 14 to a central region of the lower portion 12, as shown. Preferably, the support rib 26 is contoured to flush smoothly against the surface 15 of the handle, providing optimal comfort for the user. In the preferred embodiment, the support rib 26 is formed on the second surface of the handle, as shown. When the lower portion 12 of the handle is received by the user's open palm, the user may extend two or more adjacent fingers and dispose the support rib 26 between the user's two fingers, pressing the support rib 26 therebetween to stabilize the compact toothbrush within the user's open hand for brushing of the user's teeth. This configuration stabilizes the compact toothbrush during the brushing process.

Further, a cap 18 may be provided for releasably covering the upper head portion 14 of the handle and the plurality of toothbrush bristles 16 during transport and storage. Preferably, an annular interlocking seal 24 is formed about the neck of the handle at the interface between the upper portion 14 and the lower portion 12 thereof. The annular interlocking seal 24 is preferably formed as an annular rib, as shown. The annular seal 24 releasably and frictionally engages a lower reciprocating seal or edge 22 of the cap 18 for releasable mounting of the cap 18 on the handle. Further, the cap 18 preferably has an opening 20 formed therethrough, allowing for the evaporative drying of the toothbrush bristles 16 following use of the compact toothbrush 10. It should be understood that single opening 20 is shown for exemplary purposes only, and that a plurality of openings or, alternatively, perforations, may be provided. Although illustrated as having a substantially parabolic side cross-sectional contour, it should be understood that cap 18 may have any desired configuration. Cap 18 is preferably formed from plastic or from any other suitable rigid or semi-rigid material. It should be understood that the frictional engagement of cap 18 with annular rib 24 is shown and described above for exemplary purposes only, and that any suitable means for releasably securing cap 18 may be utilized. For example, the cap 18 may be releasably held through a snap-type fixture, through a releasable clamp, by engagement of screw threads, or through the use of any other suitable fastener, dependent upon the particular needs and desires of the user.

At least one clamping member, receiving receptacle or other retention means 28 may be provided on the lower portion 12 of the handle for releasable attachment of a container 36 to the handle. While the container 36 may contain a dentifrice, such as toothpaste or a liquid (a dilute solution of sodium bicarbonate by itself or in combination with other ingredients) or powder tooth cleaning composition, preferably the container 36 is an aerosol-type breath spray canister or a non-aerosol breath or mouth spray that provides a vapor mist for lubricating at least the anterior teeth for cosmetic cleaning. It should be understood that any suitable means for releasably securing the container 36 to the handle may be used, and the exemplary pair of clamping members 28 illustrated in FIG. 2 are for exemplary purposes only.

Any suitable type of releasable fastener or device for securing the container may be utilized, dependent upon the particular needs and desires of the user. For example, clips, clasps, clamps, receiving receptacles or any other desired means may be used for releasably securing the dentifrice container to the toothbrush.

Figure 4:
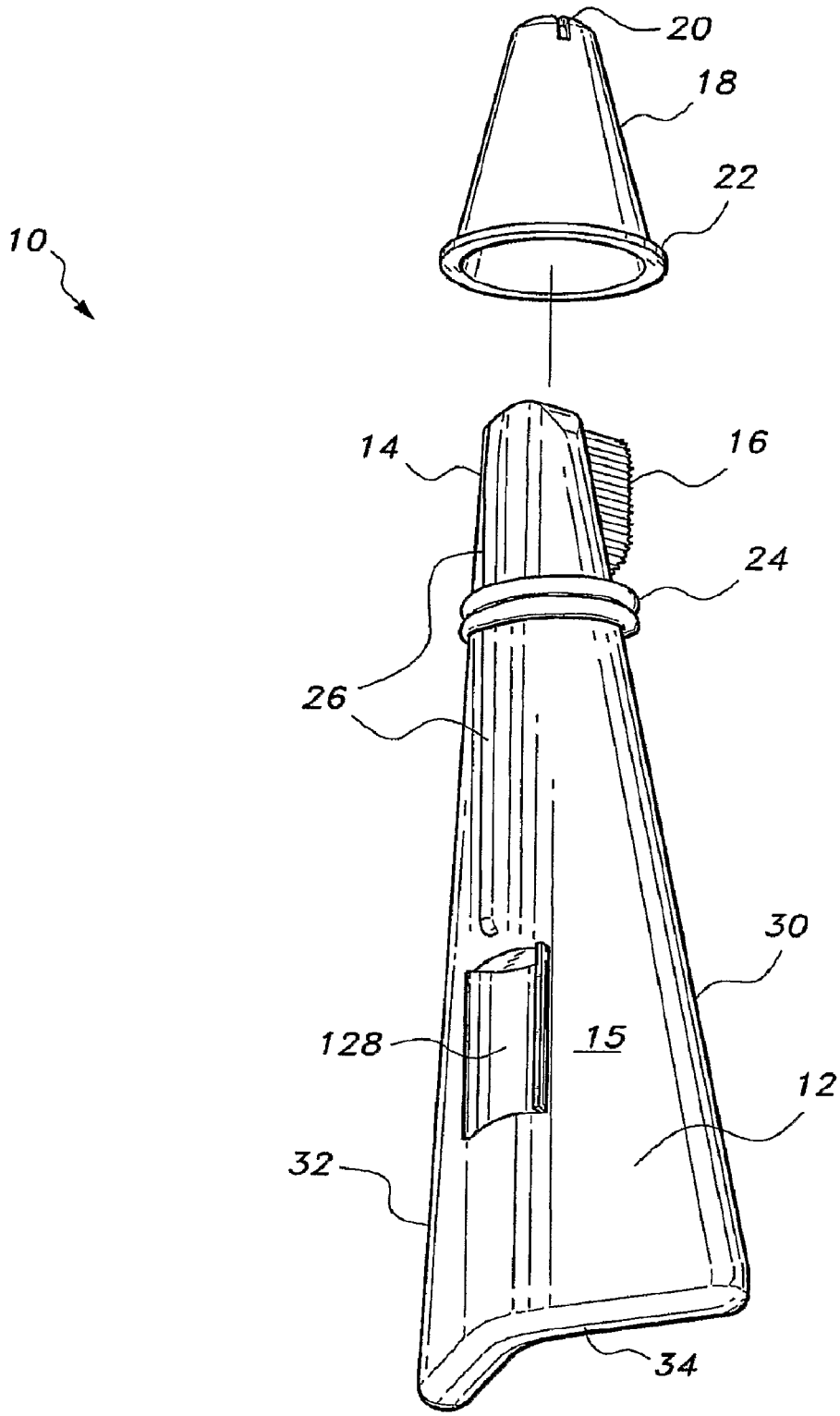
FIG. 4 is a rear perspective view of an alternative embodiment of a compact toothbrush according to the present invention.

In the alternative embodiment illustrated in FIG. 4, a receptacle 128 is formed in the handle for releasably receiving the dentifrice container 36. Clamping members 28 of FIGS. 2 and 3 are preferably formed from a resilient and flexible material, such as plastic or the like and, similarly, receiving receptacle 128 or any other desired retention means, the use of which is dependent upon the needs and desires of the user, would be formed from resilient and flexible material, such as plastic or the like.

In use, the user positions the compact toothbrush 10 within the user's open hand, as illustrated in FIG. 1, i.e., with the lower portion 12 received within the user's palm and abutting the user's carpal-hypothenar muscle. Two or more of the user's fingers (preferably, at least the user's index finger and middle finger) are extended, as shown, and the support rib 26 is disposed between the fingers. The palm may be cupped over clamp members 28. As noted above, the handle may have a substantially V-shaped or convex contour, rather than being formed as a planar article. For additional support and stability, the user may position his or her thumb within the central vertex (positioned along the longitudinal axis of the handle opposite the support rib 26 on first surface 13) or convexity during brushing. Prior to the compact toothbrush 10 being properly positioned for brushing the user's teeth, the user may apply a vapor mist (or a dentifrice, if desired) from the container 36 (with the container 36 being transported along with the toothbrush 10 through use of clamping members 28), to bristles 16, and thereafter commence brushing the user's teeth. As noted above, clamping members 28 may be replaced by any suitable retention means, such as a receiving receptacle, and the container 36, as described immediately above, would be held within, and transported along with, the receiving receptacle joined to the toothbrush handle.

The contouring and design of compact toothbrush 10, illustrated in FIGS. 1-3, allows the user to cosmetically brush his or her front bridges by exerting a gentle pressure of the brush 10 to the teeth. The user, therefore, may brush his or her teeth with the compact toothbrush 10 being completely concealed within his or her hand as viewed from a posterior vantage.

Additionally, it will be seen that the new embodiments of the non-linear toothbrush will aid those who have difficulty in brushing with a clench-fingered grip due to such physical impairments arising from arthritis or from such limitations relating to a reliance on artificial hands.

It is to be understood that the present invention is not limited to the embodiments described above, but encompasses any and all embodiments within the scope of the following claims.

The invention claimed is:

1. A compact toothbrush, comprising:

a toothbrush handle having a head portion and a lower portion, the head portion terminating in an upper edge and the lower portion terminating in a lower edge, the toothbrush handle having opposed first and second surfaces, the lower portion being dimensioned and configured for being held within, and supported by, a user's open palm, wherein the lower portion of said toothbrush handle has first and second opposed, outwardly flared side edges, the first and second side edges being joined together at the lower edge;

a plurality of toothbrush bristles mounted to the head portion and extending outwardly from the first surface; and a support rib formed on the second surface of the toothbrush handle and extending along a longitudinal axis of the toothbrush handle, the support rib extending from the upper edge of the head portion to a central region of the lower portion;

whereby when the lower portion of the toothbrush handle is cupped by the user's palm, the user may extend at least two adjacent fingers so that the support rib is disposed between the two adjacent fingers for stable support of the compact toothbrush within the user's hand for brushing of the user's teeth.

2. The compact toothbrush as recited in claim 1, further comprising a cap for releasably covering the head portion of the handle and the plurality of toothbrush bristles.

3. The compact toothbrush as recited in claim 2, further comprising means for releasably securing said cap to said toothbrush handle.

4. The compact toothbrush as recited in claim 3, wherein said means for releasably securing said cap to said toothbrush handle comprises an annular rib formed on said toothbrush handle at the interface between the head and lower portions thereof, the annular rib frictionally engaging a lower edge of the cap for releasable mounting of the cap on the head portion of the handle.

5. The compact toothbrush as recited in claim 1, further comprising an oral hygiene product container and means for releasably mounting the oral hygiene product container to said toothbrush handle.

6. The compact toothbrush as recited in claim 5, wherein the means for releasably mounting the oral product hygiene container to said toothbrush handle comprises at least one clamping member disposed on the lower portion of said toothbrush handle.

7. The compact toothbrush as recited in claim 1, further comprising an oral hygiene product container, the toothbrush handle having a receptacle formed therein, the oral hygiene product container being releasably received and secured within the receptacle.

8. The compact toothbrush as recited in claim 1, wherein said toothbrush handle has a substantially triangular contour.

9. The compact toothbrush as recited in claim 1, wherein the lower portion has a substantially V-shaped cross-sectional contour.

10. The compact toothbrush as recited in claim 1 further comprising a cap releasably covering the head portion of the toothbrush handle and the plurality of toothbrush bristles, the cap having an air flow opening formed therethrough.

11. The compact toothbrush as recited in claim 1, wherein said toothbrush handle has a substantially triangular contour, said toothbrush handle defining first, second and third corners.

12. The compact toothbrush as recited in claim 11, wherein each of said first, second and third corners is rounded.

* * * * *